US010947076B2

(12) United States Patent
Ando et al.

(10) Patent No.: US 10,947,076 B2
(45) Date of Patent: Mar. 16, 2021

(54) IMAGE FORMING APPARATUS TO WHICH POST-PROCESSING APPARATUS CAN BE CONNECTED, IMAGE FORMING SYSTEM, CONTROL METHOD THEREFOR, AND STORAGE MEDIUM STORING CONTROL PROGRAM THEREFOR

(71) Applicant: CANON KABUSHIKI KAISHA, Tokyo (JP)

(72) Inventors: Yutaka Ando, Toride (JP); Toshiyuki Miyake, Nagareyama (JP); Riki Fukuhara, Funabashi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 52 days.

(21) Appl. No.: 16/385,056

(22) Filed: Apr. 16, 2019

(65) Prior Publication Data

US 2019/0330007 A1 Oct. 31, 2019

(30) Foreign Application Priority Data

Apr. 26, 2018 (JP) ..... JP2018-085642

(51) Int. Cl.
*B65H 37/00* (2006.01)
*B65H 31/00* (2006.01)
*B65H 43/00* (2006.01)

(52) U.S. Cl.
CPC ..... *B65H 37/00* (2013.01); *B65H 31/00* (2013.01); *B65H 43/00* (2013.01)

(58) Field of Classification Search
CPC ..... B65H 31/00; B65H 37/00; B65H 43/00
USPC ..... 270/58.01, 58.07
See application file for complete search history.

(56) References Cited

U.S. PATENT DOCUMENTS 7,900,905 B2 * 3/2011 Kiriyama ..... B42C 1/125 270/58.02
7,954,808 B2 * 6/2011 Tomida ..... B65H 31/10 270/58.01
8,985,573 B2 * 3/2015 Konishi ..... B65H 39/00 270/58.08

(Continued)

FOREIGN PATENT DOCUMENTS

JP 2014092749 A 5/2014

*Primary Examiner* — Leslie A Nicholson, III
(74) *Attorney, Agent, or Firm* — Rossi, Kimms & McDowell LLP

(57) ABSTRACT

An image forming apparatus that is capable of reducing influence of a failure on execution of a print job even if a post-processing apparatus that has a sheet stacking unit breaks down. Post-processing apparatuses are connected at a downstream side of an image forming apparatus in a sheet conveyance direction and apply post-processes to the sheet discharged from the image forming apparatus. A specifying unit specifies an available downstream-most apparatus from among the post-processing apparatuses. A setting unit can set a forced discharge mode in which a sheet is discharged to the downstream-most apparatus when the downstream-most apparatus is not provided with a sheet stacking unit. When the forced discharge mode is set, apparatuses at an upstream side of the downstream-most apparatus are controlled so as to discharge a sheet to the downstream-most apparatus and the downstream-most apparatus is controlled so as to discharge the sheet outside the apparatus.

12 Claims, 10 Drawing Sheets

(56) References Cited

U.S. PATENT DOCUMENTS 9,809,409 B2 * 11/2017 Tominaga ..... B65H 39/10

* cited by examiner

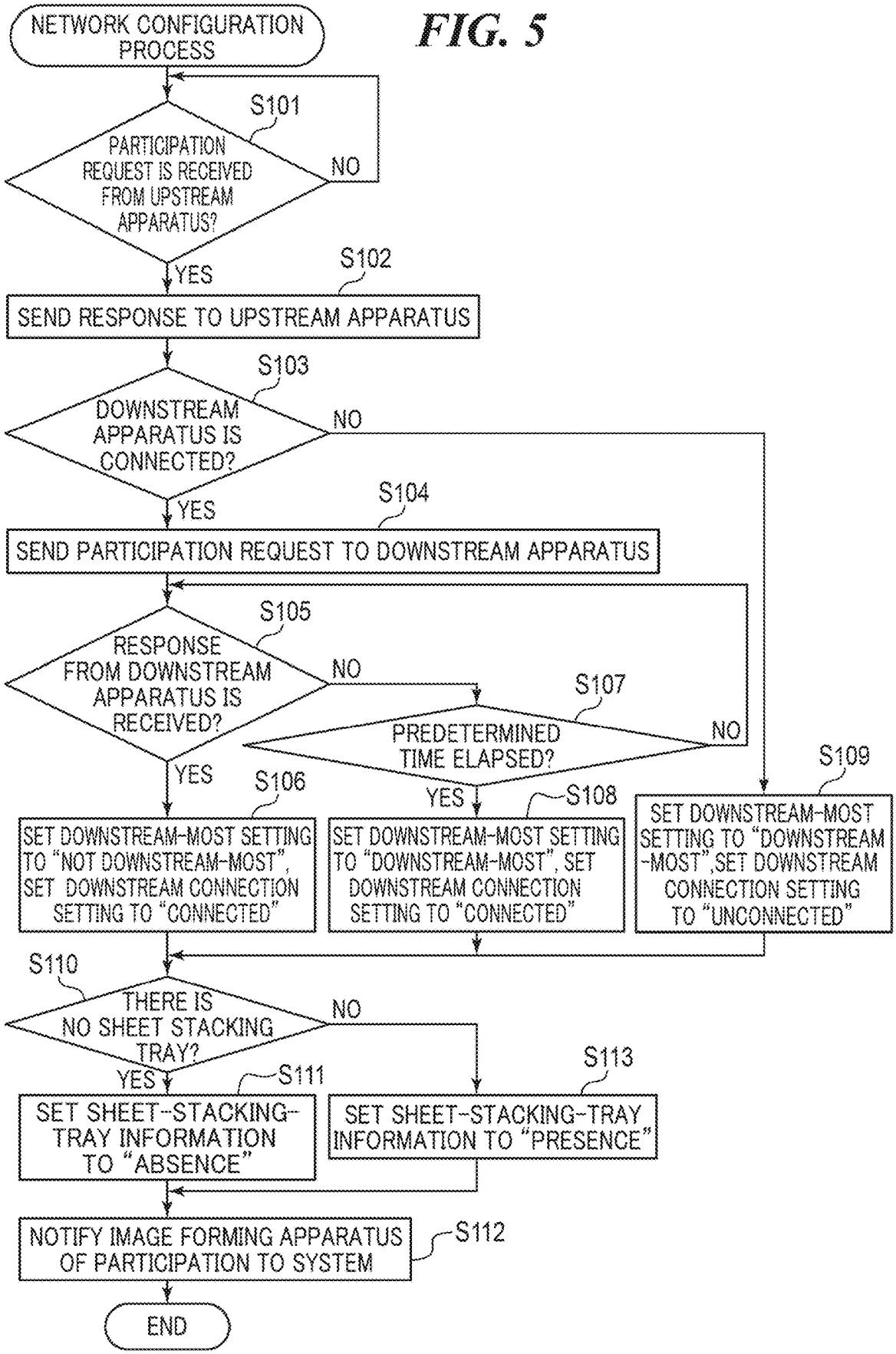
FIG. 5
NETWORK CONFIGURATION PROCESS
S101
PARTICIPATION REQUEST IS RECEIVED FROM UPSTREAM APPARATUS?
NO
YES
S102
SEND RESPONSE TO UPSTREAM APPARATUS
S103
DOWNSTREAM APPARATUS IS CONNECTED?
NO
YES
S104
SEND PARTICIPATION REQUEST TO DOWNSTREAM APPARATUS
S105
RESPONSE FROM DOWNSTREAM APPARATUS IS RECEIVED?
NO
S107
PREDETERMINED TIME ELAPSED?
NO
YES
YES
S106
SET DOWNSTREAM-MOST SETTING TO "NOT DOWNSTREAM-MOST", SET DOWNSTREAM CONNECTION SETTING TO "CONNECTED"
S108
SET DOWNSTREAM-MOST SETTING TO "DOWNSTREAM-MOST", SET DOWNSTREAM CONNECTION SETTING TO "CONNECTED"
S109
SET DOWNSTREAM-MOST SETTING TO "DOWNSTREAM -MOST",SET DOWNSTREAM CONNECTION SETTING TO "UNCONNECTED"
S110
THERE IS NO SHEET STACKING TRAY?
NO
YES
S111
SET SHEET-STACKING-TRAY INFORMATION TO "ABSENCE"
S113
SET SHEET-STACKING-TRAY INFORMATION TO "PRESENCE"
NOTIFY IMAGE FORMING APPARATUS OF PARTICIPATION TO SYSTEM
S112
END

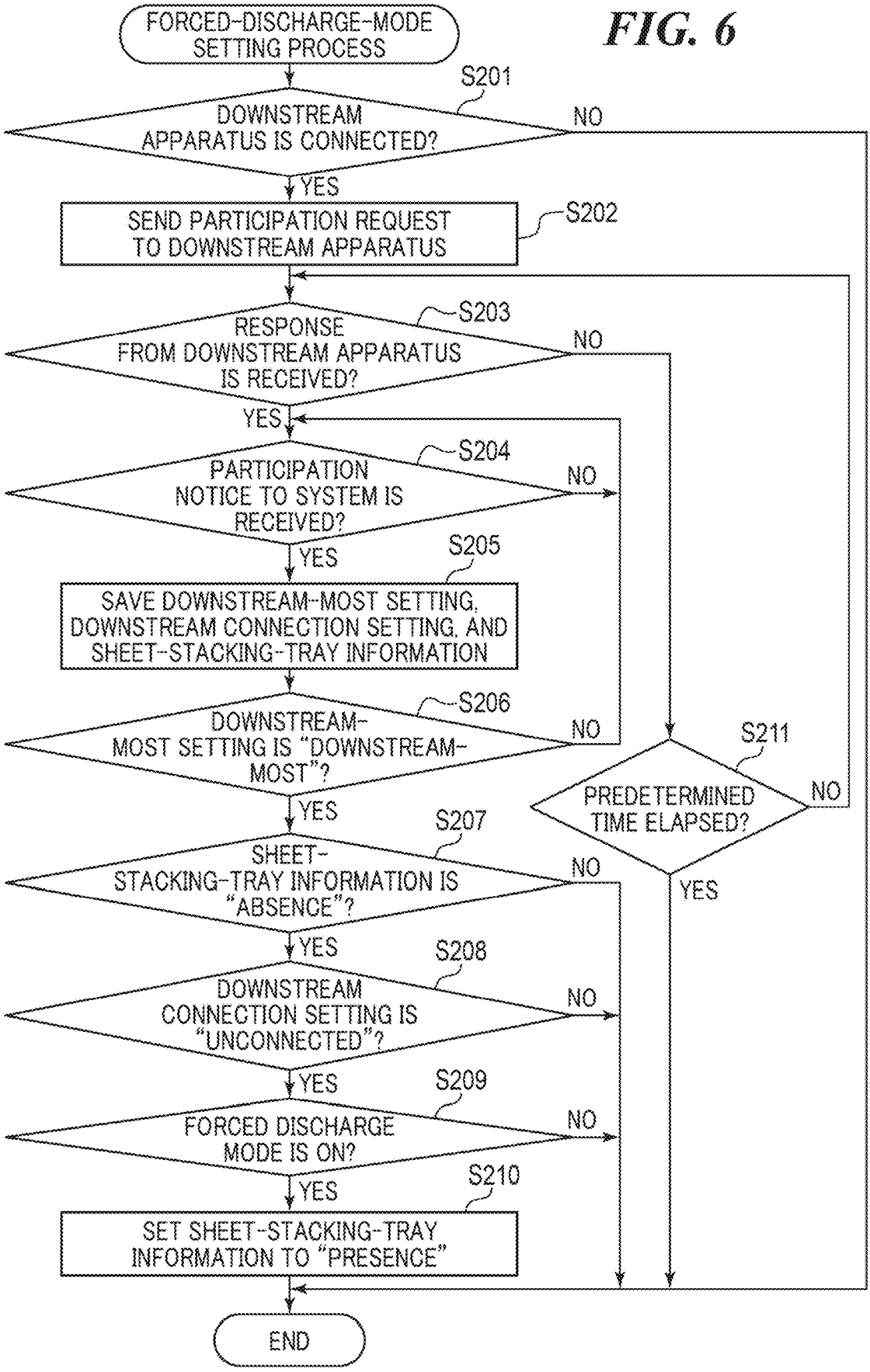
FIG. 6
FORCED-DISCHARGE-MODE SETTING PROCESS
S201
DOWNSTREAM APPARATUS IS CONNECTED?
NO
YES
SEND PARTICIPATION REQUEST TO DOWNSTREAM APPARATUS
S202
S203
RESPONSE FROM DOWNSTREAM APPARATUS IS RECEIVED?
NO
YES
S204
PARTICIPATION NOTICE TO SYSTEM IS RECEIVED?
NO
YES
S205
SAVE DOWNSTREAM-MOST SETTING, DOWNSTREAM CONNECTION SETTING, AND SHEET-STACKING-TRAY INFORMATION
S206
DOWNSTREAM-MOST SETTING IS "DOWNSTREAM-MOST"?
NO
YES
S211
PREDETERMINED TIME ELAPSED?
NO
YES
S207
SHEET-STACKING-TRAY INFORMATION IS "ABSENCE"?
NO
YES
S208
DOWNSTREAM CONNECTION SETTING IS "UNCONNECTED"?
NO
YES
S209
FORCED DISCHARGE MODE IS ON?
NO
YES
S210
SET SHEET-STACKING-TRAY INFORMATION TO "PRESENCE"
END

IMAGE FORMING APPARATUS TO WHICH POST-PROCESSING APPARATUS CAN BE CONNECTED, IMAGE FORMING SYSTEM, CONTROL METHOD THEREFOR, AND STORAGE MEDIUM STORING CONTROL PROGRAM THEREFOR

BACKGROUND OF THE INVENTION

Field of the Invention

The present invention relates to an image forming apparatus, an image forming system that is configured by connecting a post-processing apparatus to the image forming apparatus, a control method therefor, and a storage medium storing a control program therefor.

Description of the Related Art

There is a known image forming system that is configured by connecting a plurality of post-processing apparatuses that apply post processes to a sheet on which an image has been formed to an image forming apparatus that forms an image on a sheet.

In such an image forming system, a staple process, a folding process, or a saddle stitching process that combines the staple process and the folding process may be applied as a post-process to a sheet on which an image has been formed, for example. In the meantime, when a post-processing apparatus that is not provided with a discharge conveying path for discharging a sheet that is not subjected to a post process outside the apparatus is connected to the image forming apparatus, forced discharge of the sheet that is not subjected to the post process may cause an error like a paper jam. Accordingly, there is a known technique of prohibiting setting of no post process in such a system (Japanese Laid-Open Patent Publication (Kokai) No. 2014-92749 (JP 2014-92749A)).

In the meantime, in an image forming system to which a plurality of post-processing apparatuses are connected, when the downstream-most post-processing apparatus that has a sheet stacking tray breaks down and is separated from the system, and when a post-processing system that does not have a sheet stacking tray newly becomes the downstream-most apparatus, a discharged sheet cannot be stacked. Accordingly, in such a case, even if the downstream-most post-processing apparatus is provided with a discharge conveying path along which a sheet is discharged outside, the downstream-most post-processing apparatus concerned is prohibited from taking in a sheet.

That is, the image forming system in which a post-processing apparatus that does not have a sheet stacking tray becomes the downstream-most apparatus cannot execute a print job.

Moreover, when a post-processing apparatus other than the downstream-most apparatus is provided with a sheet stacking tray, it is possible to make this post-processing apparatus discharge a sheet. However, this case disables post-processes of the downstream apparatuses than the post-processing apparatus concerned that is provided with the sheet stacking tray.

In this way, the above-mentioned prior art has a problem that remarkably restricts a print job or an executable post-process when a post-process apparatus breaks down, for example, when the downstream-most post-processing apparatus that has a sheet stacking unit breaks down and is separated from the system.

SUMMARY OF THE INVENTION

The present disclosure provides an image forming apparatus, an image forming system, a control method therefor, and a storage medium storing a control program therefor, which are capable of reducing influence of a failure on execution of a print job or a post-processing function of a post-processing apparatus even if a post-processing apparatus that has a sheet stacking unit breaks down.

Accordingly, a first aspect of the present embodiments provides an image forming system including an image forming apparatus that forms an image on a sheet, one or more post-processing apparatuses that are connected at a downstream side of the image forming apparatus in a sheet conveyance direction and that apply predetermined post-processes to the sheet that is discharged from the image forming apparatus, a specifying unit configured to specify an available downstream-most apparatus from among the one or more post-processing apparatuses, a setting unit configured to be able to set a forced discharge mode in which a sheet is discharged to the post-processing apparatus specified as the downstream-most apparatus by the specifying unit in a case where the post-processing apparatus specified is not provided with a sheet stacking unit for stacking a sheet after the post-process, and a controller configured to control apparatuses at an upstream side of the post-processing apparatus specified as the downstream-most apparatus so as to discharge a sheet to the post-processing apparatus specified and to control the post-processing apparatus specified so as to discharge the sheet outside the apparatus after applying a predetermined post-process in a case where the setting unit sets the forced discharge mode.

Accordingly, a second aspect of the present embodiments provides a control method for an image forming system including an image forming apparatus that forms an image on a sheet and one or more post-processing apparatuses that are sequentially connected at a downstream side of the image forming apparatus in a sheet conveyance direction and that apply predetermined post-processes to the sheet that is discharged from the image forming apparatus, the control method including a specifying step of specifying an available downstream-most apparatus from among the one or more post-processing apparatuses, a setting step of being able to set a forced discharge mode in which a sheet is discharged to the post-processing apparatus specified as the downstream-most apparatus in the specifying step in a case where the post-processing apparatus specified is not provided with a sheet stacking unit for stacking a sheet to which the post-process is applied, and a control step of controlling apparatuses at an upstream side of the post-processing apparatus specified as the downstream-most apparatus so as to discharge a sheet to the post-processing apparatus specified and of controlling the post-processing apparatus specified so as to discharge the sheet outside the apparatus after applying a predetermined post-process in a case where the setting unit sets the forced discharge mode.

Accordingly, a third aspect of the present embodiments provides a non-transitory computer-readable storage medium storing a control program causing a computer to execute the control method of the second aspect.

Accordingly, a fourth aspect of the present embodiments provides an image forming apparatus including an image forming unit configured to form an image on a sheet, a determination unit configured to determine whether one or more post-processing apparatuses that apply predetermined post-processes to a sheet after an image formation are connected, an obtaining unit configured to obtain information about whether a downstream-most post-processing apparatus among the one or more post-processing apparatuses is provided with a sheet stacking unit for stacking a sheet after a post-process in a case where the determination unit determines that the one or more post-processing apparatuses are connected, a setting unit configured to set whether discharge of a sheet to the downstream-most post-processing apparatus is allowed in a case where the downstream-most post-processing apparatus is not provided with the sheet stacking unit, and a controller configured to control so as to discharge a sheet to the downstream-most post-processing apparatus that is not provided with the sheet stacking unit in a case where the setting unit sets to allow discharge of a sheet and to control so as not to discharge a sheet to the downstream-most post-processing apparatus that is not provided with the sheet stacking unit in a case where the setting unit does not set to allow discharge of a sheet.

Further features of the present disclosure will become apparent from the following description of exemplary embodiments with reference to the attached drawings.

BRIEF DESCRIPTION OF THE DRAWINGS

FIG. 5 is a flowchart showing procedures of a network construction process executed by the image forming system.

FIG. 6 is a flowchart showing procedures of a forced-discharge-mode setting process executed by the image forming system.

DESCRIPTION OF THE EMBODIMENTS

Figure 1:
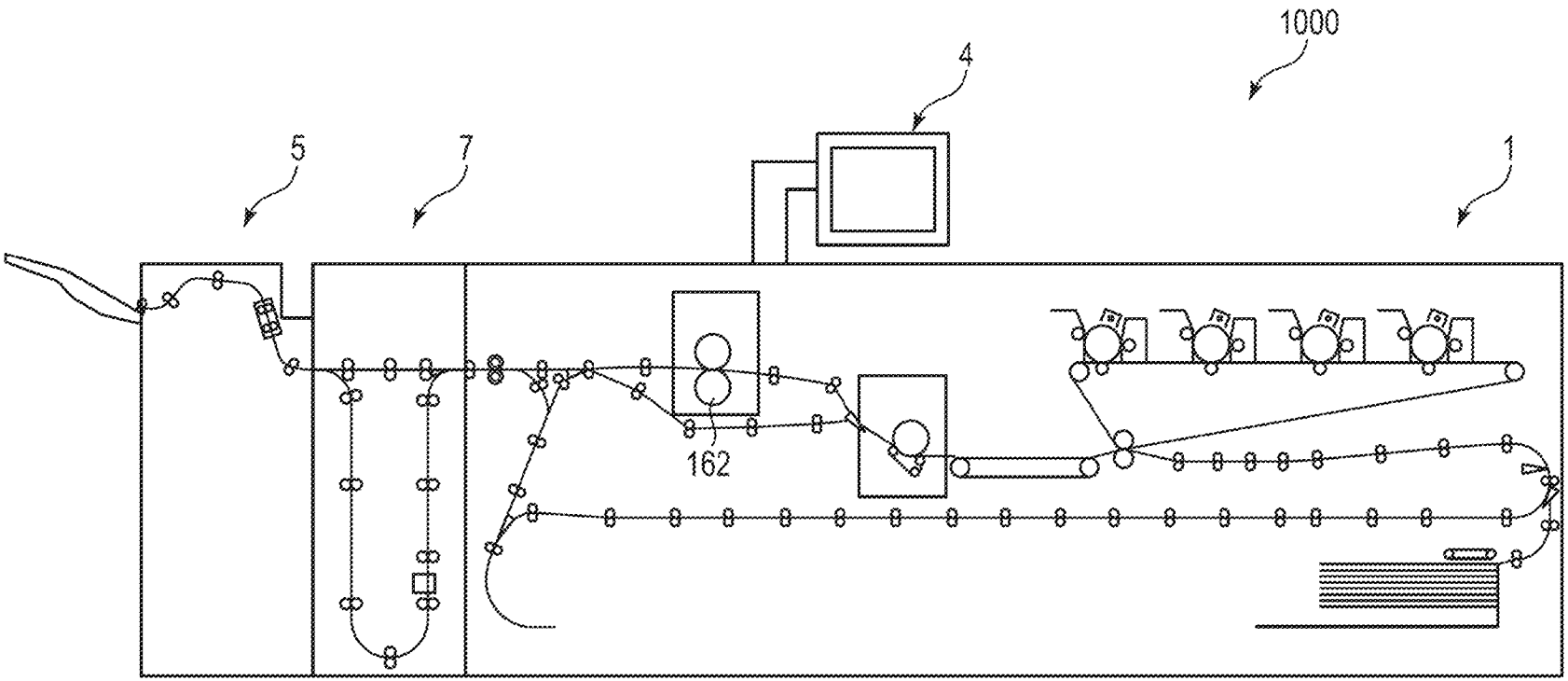
FIG. 1 is a longitudinal sectional view schematically showing a configuration of an image forming apparatus according to an embodiment.

Hereafter, embodiments according to the present invention will be described in detail by referring to the drawings.

FIG. 1 is a longitudinal sectional view schematically showing a configuration of an image forming apparatus according to the embodiment.

As shown in FIG. 1, the image forming system 1000 mainly consists of an image forming apparatus 1 and post-processing apparatuses, which are a puncher 7 and a finisher 5, connected in order at the left side of the image forming apparatus 1 in FIG. 1, that is, at a downstream side of the image forming apparatus 1 in a sheet conveyance direction. An operation display unit 4 is provided in an upper portion of the image forming apparatus 1. The operation display unit 4 functions as a user interface.

The image forming apparatus 1 forms an image on a sheet according to a user's instruction input through the operation display unit 4, for example. The puncher 7 performs a punch process that opens a punch hole in a sheet discharged from the image forming apparatus 1. The finisher 5 has a sheet stacking tray as a sheet stacking unit, and discharges a sheet to the sheet stacking tray after applying a post-process like shift sorting to the sheet discharged from the puncher 7.

Each of the puncher 7 and finisher 5 receives a sheet from a right-side apparatus and discharges the sheet to a left-side apparatus in FIG. 1. Accordingly, the right-side of each of the image forming apparatus 1, puncher 7, and finisher 5 in FIG. 1 is referred to as an upstream side and the left-side is referred to as a downstream side.

Figure 2:
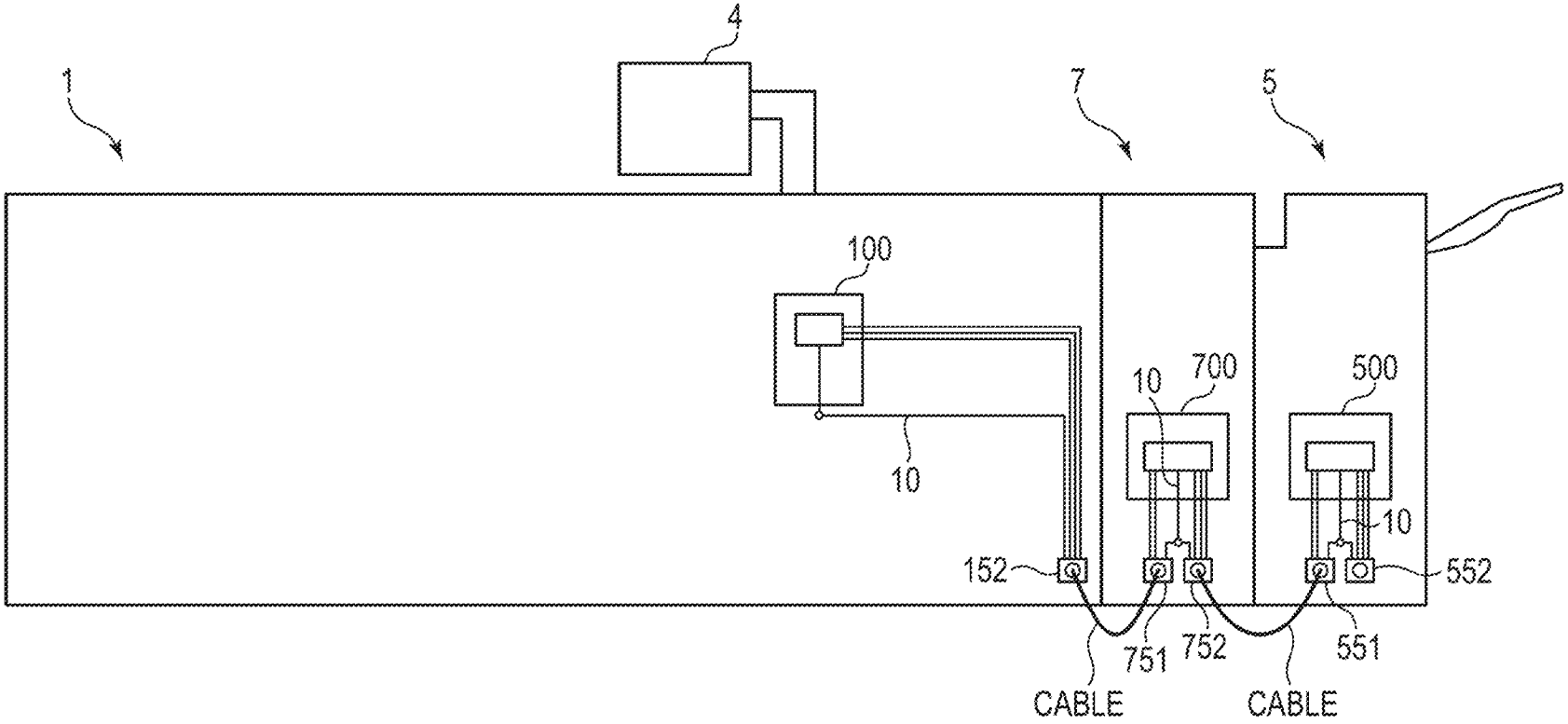
FIG. 2 is an external view showing the image forming system in FIG. 1 viewed from a back face.

FIG. 2 is an external view of the image forming system 1000 in FIG. 1 viewed from a back face.

As shown in FIG. 2, the image forming apparatus 1 is provided with a connector 152 and a controller 100, and the connector 152 is connected to the controller 100 by wiring. Moreover, the puncher 7 is provided with connectors 751 and 752 and a controller 700, and the connectors 751 and 752 are connected to the controller 700 by wiring. Furthermore, the finisher 5 is provided with connectors 551 and 552 and a controller 500, and the connectors 551 and 552 are connected to the controller 500 by wiring.

The connector 152 of the image forming apparatus 1 and the connector 751 of the puncher 7 are connected by a cable. The connector 752 of the puncher 7 and the connector 551 of the finisher 5 are connected by a cable. Moreover, each of the connector 152 of the image forming apparatus 1, the connector 752 of the puncher 7, and the connector 552 of the finisher 5 is constituted so that termination resistance will be internally connected to a bus line of a network bus 10 to which the apparatuses are connected when a cable is not connected.

Next, the configurations of the controllers of the apparatuses in the image forming system 1000 will be described.

Figure 3:
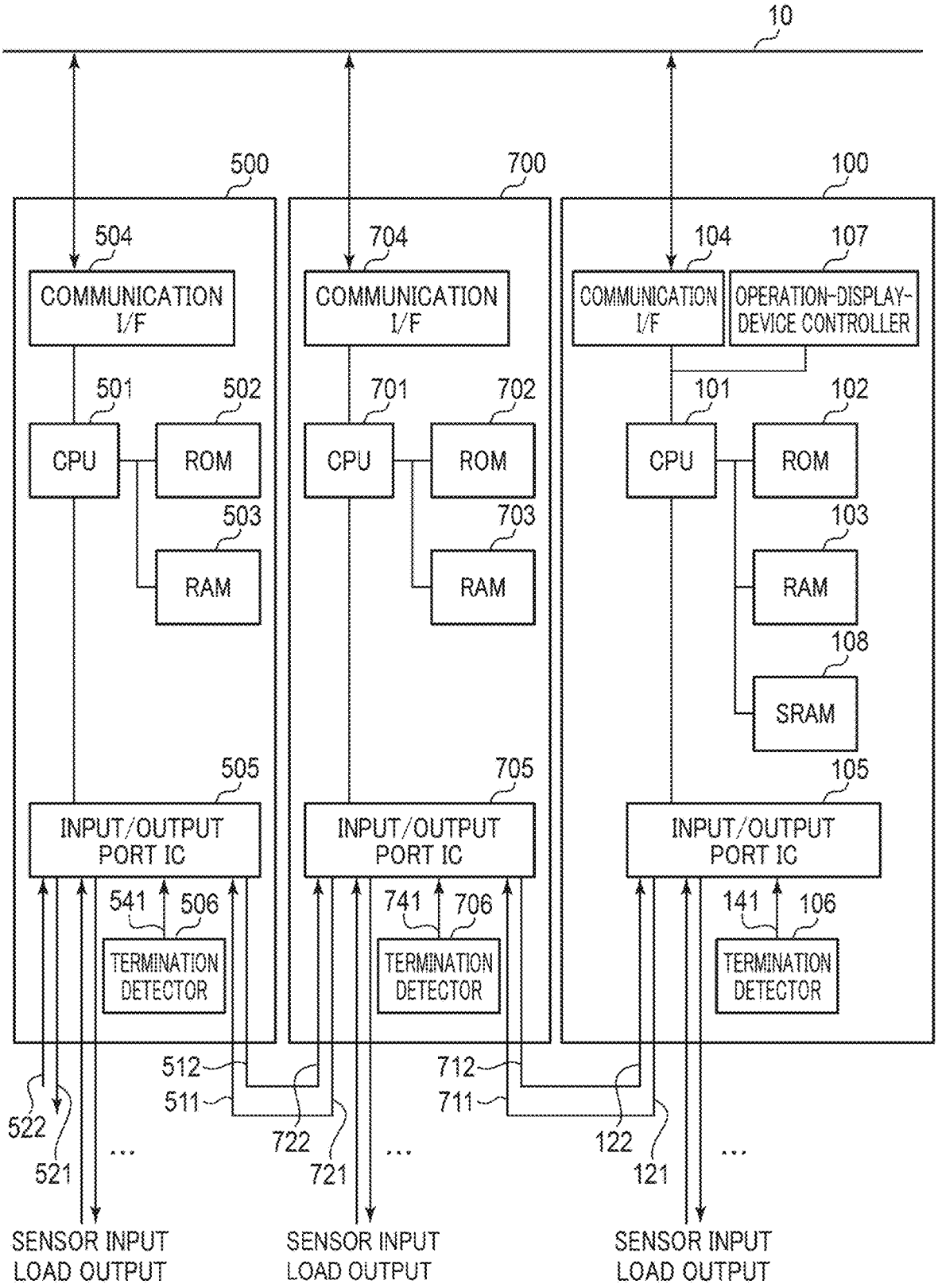
FIG. 3 is a block diagram showing configurations of controllers of an image forming apparatus, a puncher, and a finisher of the image forming system in FIG. 1 and showing mutual communication connection relations between the controllers.

FIG. 3 is a block diagram showing the configurations of the controllers 100, 700, and 500 of the image forming apparatus 1, puncher 7, and finisher 5, and communication connection relations between the controllers. The bus line of the network bus 10 is included in the cables between the controllers in FIG. 3, and each of the controllers 100, 700, and 500 is connected to the network bus 10 by connecting a cable. Any controller is able to send data to all the other controllers that are connected to the network bus 10 (broadcasting) and is able to start data transmission by oneself (multi-master).

The network bus 10 is able to use communication methods, such as Ethernet, CAN (Controller Area Network), and Arcnet, that enable the multi-master and broadcasting.

The controller 100 of the image forming apparatus 1 is provided with a CPU 101. The CPU 101 is connected to a ROM 102, a RAM 103, a communication I/F (interface) 104, an input/output port IC 105, an operation-display-device controller 107, and an SRAM 108 through an address bus or a data bus. Moreover, the CPU 101 is constituted so that termination detection is available through the input/output port IC 105 and a termination detector 106. The termination detection means a function of a specifying unit to specify whether the apparatus concerned is an apparatus located at the downstream-most position among a plurality of apparatuses that constitute the image forming system 1000. Hereinafter, the apparatus at the downstream-most position is referred to as a downstream-most apparatus.

The CPU 101 performs basic control of the image forming apparatus 1 as mention later. The ROM 102 stores a control program and an application program. The RAM 103 is a volatile memory that functions as a work area for running the control program. The SRAM 108 is a nonvolatile memory in which various settings are saved.

The CPU 101 is connected to the network bus 10 through the communication I/F 104. The CPU 101 transmits and receives control data to and from the controller 700 of the puncher 7 and the controller 500 of the finisher 5 through the network bus 10. As a result of this, the CPU 101 communicates with each post-processing apparatus at a high speed than daisy chain connection etc., and performs control about each post-processing apparatus, such as transfer of a sheet and display of status.

The CPU 101 obtains signals from the termination detector 106 and sensors (not shown) through the input/output port IC 105 according to the control program stored in the ROM 102. Moreover, the CPU 101 controls conveyance of a sheet and image formation to a sheet by outputting control signals to various loads (not shown), such as a motor and a clutch. It should be noted that a sheet on the conveyance path in the image forming apparatus and a sheet discharged from the image forming apparatus are sequentially conveyed to the puncher 7 and the finisher 5 that are the downstream post-processing apparatuses.

Moreover, the CPU 101 controls display and key input in the operation display unit 4. That is, the CPU 101 controls a display section of the operation display unit 4 so as to display an operating state of the image forming apparatus 1 and an operation mode set up by key input. A user is able to instruct the CPU 101 about the operation mode of the image forming apparatus 1 and about switching of the display on the operation display unit 4 through the key input to the operation display unit 4.

The controller 700 of the puncher 7 is provided with a CPU 701. The CPU 701 is connected to a ROM 702, a RAM 703, a communication I/F 704, and an input/output port IC 705 through the address bus or the data bus. Moreover, the CPU 701 is constituted so that termination detection will be available through the input/output port IC 705 and a termination detector 706.

The CPU 701 performs basic control of the puncher 7. The ROM 702 stores a control program and an application program. The RAM 703 functions as a work area for running the control program.

The CPU 701 is connected to the network bus 10 through the communication I/F 704. The CPU 701 transmits and receives control data to and from the controller 100 of the image forming apparatus 1 and the controller 500 of the finisher 5 through the network bus 10. As a result of this, the CPU 701 control transfer of a sheet between the image forming apparatus 1 and the finisher 5.

The CPU 701 obtains signals from the termination detector 706 and sensors (not shown) through the input/output port IC 705 according to the control program stored in the ROM 702. Moreover, the CPU 701 controls conveyance of a sheet and a post process to a sheet by outputting control signals to various loads (not shown), such as a motor and a clutch. It should be noted that a sheet discharged from the puncher 7 is conveyed to the finisher 5 that is a downstream post-processing apparatus.

The controller 500 of the finisher 5 is provided with a CPU 501. The CPU 501 is connected to a ROM 502, a RAM 503, a communication I/F 504, and an input/output port IC 505 through the address bus or the data bus. Moreover, the CPU 501 is configured so that the termination detection will be available through the input/output port IC 505 and a termination detector 506.

The CPU 501 performs basic control of the finisher 5. The ROM 502 stores a control program and an application program. The RAM 503 functions as a work area for running the control program.

The CPU 501 is connected to the network bus 10 through the communication I/F 504. The CPU 501 transmits and receives control data to and from the controller 100 of the image forming apparatus 1 and the controller 700 of the puncher 7 through the network bus 10. As a result of this, the CPU 501 controls transfer of a sheet between the image forming apparatus 1 and the puncher 7.

The CPU 501 obtains signals from the termination detector 506 and sensors (not shown) through the input/output port IC 505 according to the control program stored in the ROM 502. Moreover, the CPU 501 controls conveyance of a sheet and a post process to a sheet by outputting control signals to various loads (not shown), such as a motor and a clutch.

The cables between the apparatuses in FIG. 3 include wiring other than the bus line of the network bus 10, an input/output port IC of each controller is connectable to an input/output port IC of an adjacent controller.

Specifically, an output port 121 of the input/output port IC 105 of the controller 100 is connected to an input port 711 of the input/output port IC 705 of the controller 700. Moreover, an input port 122 of the input/output port IC 105 of the controller 100 is connected to an output port 712 of the input/output port IC 705 of the controller 700. This enables the CPU 101 and the CPU 701 to detect ON/OFF notifications from the CPU 701 and the CPU 101, respectively. At this time, a signal of an input port 141 of the input/output port IC 105 connected to the termination detector 106 becomes OFF, which shows that the image forming apparatus 1 is not the downstream-most apparatus of the system. The signal of the input port 141 functions as a connection detection signal of a downstream apparatus.

Moreover, an output port 721 of the input/output port IC 705 of the controller 700 is connected to an input port 511 of the input/output port IC 505 of the controller 500. Moreover, an input port 722 of the input/output port IC 705 of the controller 700 is connected to an output port 512 of the input/output port IC 505 of the controller 500. This enables the CPU 501 and the CPU 701 to detect ON/OFF notifications from the CPU 701 and the CPU 501, respectively. At this time, a signal of an input port 741 of the input/output port IC 705 connected to the termination detector 706 becomes OFF, which shows that the puncher 7 is not the downstream-most apparatus of the system.

Moreover, an output port 521 and an input port 522 of the input/output port IC 505 of the controller 500 are not connected. At this time, a signal of an input port 541 of the input/output port IC 505 connected to the termination detector 506 is turned ON. This defines that the finisher 5 having the controller 500 is a downstream-most apparatus of the image forming system 1000. If a post-processing apparatus is arranged at the downstream side of the finisher 5 and is connected to the finisher 5 through a cable, the signal of the input port 541 is turned OFF, which shows that an apparatus is connected at the downstream side of the finisher 5.

Next, the operation display unit 4 in FIG. 1 will be described.

Figure 4A:
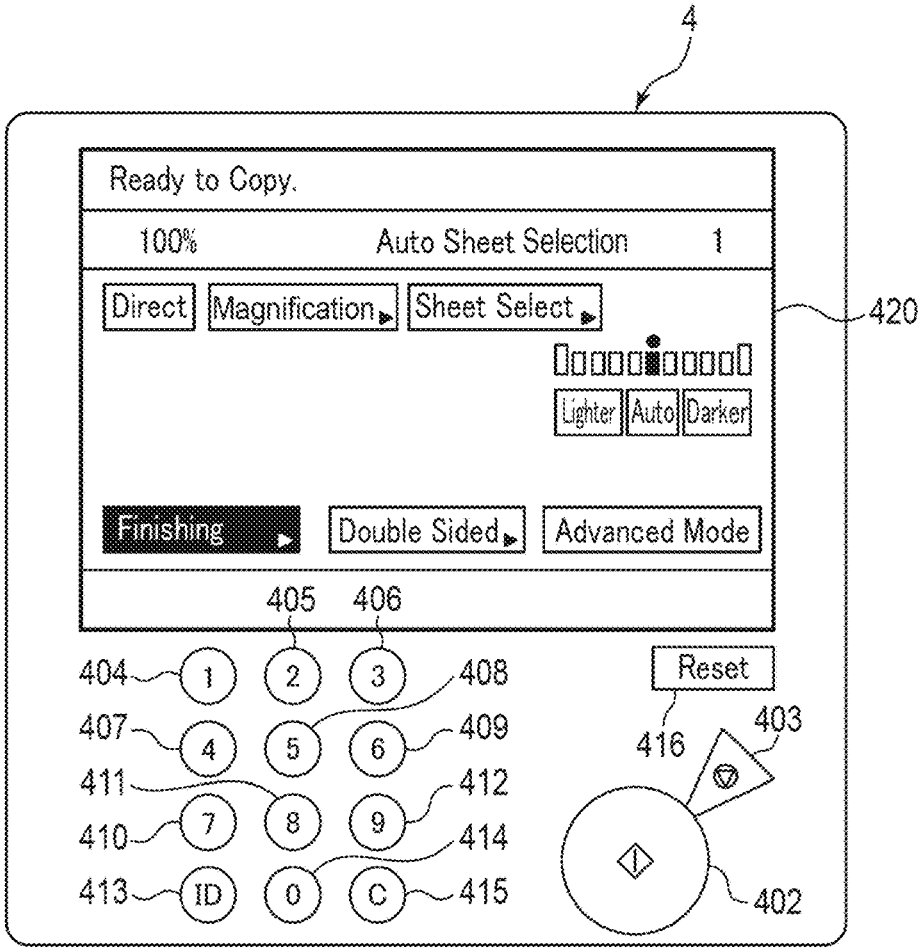
FIG. 4A is a view showing an operation display unit in the image forming system.

FIG. 4A is a view showing the operation display unit 4 in the image forming system 1000 in FIG. 1. As shown in FIG. 4A, a start key 402 for starting an image forming operation and a stop key 403 for interrupting the image forming operation are provided in an operation section of the operation display unit 4. Moreover, numeral keys 404 through 412 and 414 for setting a substituted number, an ID key 413, a clear key 415, a reset key 416, etc. are arranged in the operation section. Moreover, a display section 420 equipped with a touch panel is arranged in the upper area adjacent to the operation section. Softkeys are displayed on the display section 420.

In the image forming system in FIG. 1, a post-process mode can be set up by selecting from among various process modes, such as a non-sort mode and a sort mode. A process mode is set up by an input operation through the operation display unit 4. For example, when a user selects a "Finishing" key that is a softkey on an initial screen shown in FIG. 4A for setting up a post-process mode, a discharging-apparatus selection screen shown in FIG. 4B will be displayed on the display section 420. The user sets up the apparatus that discharges a sheet using the discharging-apparatus selection screen. Since the puncher 7 does not have a sheet stacking tray, only the finisher 5 is displayed as a choice in the configuration of this embodiment. If another post-processing apparatus that has a sheet stacking tray, such as a case binding apparatus, is connected to the system other than the finisher, the case binding apparatus and the finisher will be displayed as choices of the discharging apparatus.

Figure 4B:
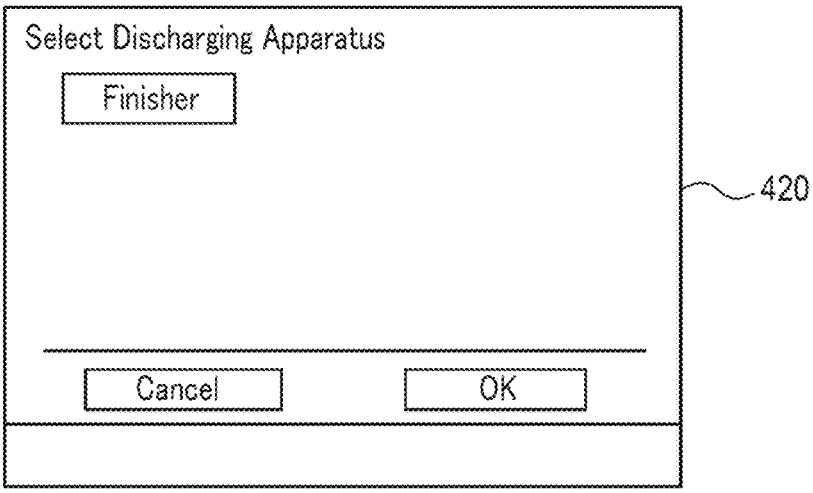
FIG. 4B is a view showing a discharging-apparatus selection screen displayed on a display section of the operation display unit in FIG. 4A.
Figure 4C:
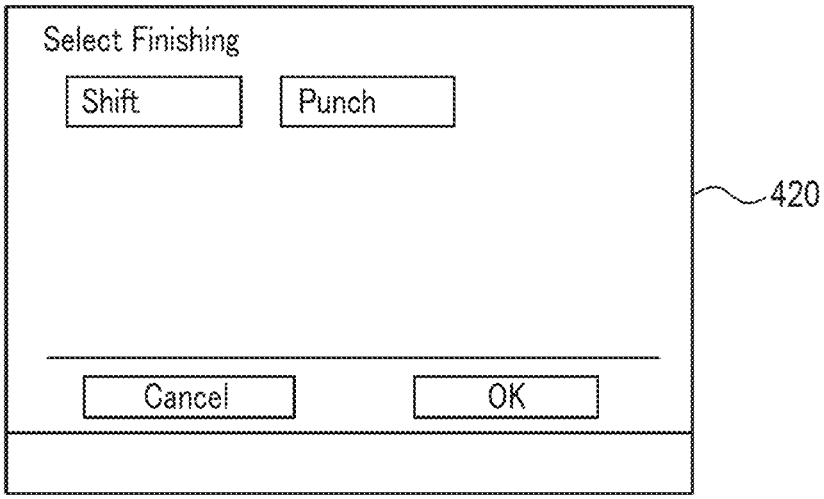
FIG. 4C is a view showing a finishing-function selection screen displayed on the display section of the operation display unit in FIG. 4A.

For example, in FIG. 4B, when the user selects the "Finisher" as the discharging apparatus and presses the "OK" key in FIG. 4B, a finishing selection screen as shown in FIG. 4C will be displayed on the display section 420. The user sets up the process mode on the finishing selection screen.

For example, when the user touches the "OK" key while selecting a "Shift" key in FIG. 4C to finish selecting the finishing, a shift mode is set up. Moreover, when the user touches the "OK" key while selecting a "Punch" key to finish selecting the finishing, a punch mode is set up. It should be noted that the user may select both the "Shift" and "Punch".

Next, a network construction process executed by the image forming system in FIG. 1 will be described. The network construction process is executed by the image forming apparatus 1 or the post-processing apparatus connected to the image forming apparatus 1 when the power is supplied to the image forming system 1000. Hereinafter, the network construction process executed by the puncher 7 will be described.

FIG. 5 is a flowchart showing procedures of the network construction process executed by the image forming system 1000. The CPU 701 of the puncher 7 that is the post-processing apparatus in the image forming system 1000 executes the network construction process according to the network construction program stored in the ROM 702.

As shown in FIG. 5, when the network construction process is started, the CPU 701 of the puncher 7 first determines whether a participation request is received from the image forming apparatus 1 as an upstream apparatus, and waits until receiving the participation request (step S101). That is, the CPU 701 checks whether the input port 711 is ON or OFF. When the port is OFF and the participation request has not been received, the CPU 701 waits until the port becomes ON by receiving the participation request. As a result of the determination in the step S101, when the input port 711 becomes ON in response to the participation request to the system from the image forming apparatus 1 ("YES" in the step S101), the CPU 701 proceeds with the process to step S102. That is, the CPU 701 turns ON the output port 712 in response to the participation request from the image forming apparatus 1 as the upstream apparatus (the step S102). It should be noted that a process that the image forming apparatus 1 as the upstream apparatus sends the participation request to the system to the puncher 7 will be described later.

After responding to the participation request from the image forming apparatus 1 (the step S102), the CPU 701 proceeds with the process to step S103. That is, the CPU 701 determines whether another post-processing apparatus is connected to the downstream side (the step S103). As a result of the determination in the step S103, when the input port 741 is OFF and a downstream apparatus is connected ("YES" in the step S103), the CPU 701 proceeds with the process to step S104.

That is, the CPU 701 turns ON the output port 721 to send the participation request to the system to the finisher 5 as the downstream apparatus (the step S104). After sending the participation request to the system to the downstream apparatus (the step S104), the CPU 701 determines whether a response from the finisher 5 is received (i.e., whether the input port 722 is turned ON) in step S105. As a result of the determination in the step S105, when the input port 722 becomes ON resulting of receiving the response from the downstream apparatus ("YES" in the step S105), the CPU 701 proceeds with the process to step S106. Namely, the CPU 701 sets a downstream-most setting stored in the RAM 703 to "non-downstream-most" and sets a downstream connection setting to "connected" (the step S106). As a result of this, the RAM 703 stores that the puncher 7 is not the downstream-most apparatus and stores that another post-processing apparatus, which is the finisher 5, for example, is connected to the downstream side of the puncher 7.

After setting the downstream-most setting to "non-downstream-most" and setting the downstream connection setting to "connected" (the step S106), the CPU 701 proceeds with the process to step S110. That is, the CPU 701 determines whether the puncher 7 that is an own apparatus has a sheet stacking tray (the step S110). As a result of the determination in the step S110, when the own apparatus does not have a sheet stacking tray ("YES" in the step S110), the CPU 701 proceeds with the process to step S111.

That is, the CPU 701 sets sheet-stacking-tray information stored in the RAM 703 to "absence" (the step S111). After setting the sheet-stacking-tray information to "absence" (the step S111), the CPU 701 notifies the image forming apparatus 1 of the participation of the puncher 7 to the system through communication I/F 704 (step S112) and finishes this process after that. At this time, the CPU 701 notifies the image forming apparatus 1 of the setting contents of the downstream-most setting and downstream connection setting, and the sheet-stacking-tray information, which are stored in the RAM 703, as additional information.

In the meantime, as a result of the determination in the step S110, when the own apparatus has a sheet stacking tray ("NO" in the step S110), the CPU 701 proceeds with the process to step S113. Namely, the CPU 701 sets the sheet-stacking-tray information stored in the RAM 703 to "presence" (the step S113) and proceeds with the process to the step S112 after that.

Moreover, as a result of the determination in the step S105, when the input port 722 is OFF and there is no response from the finisher 5 as the downstream apparatus ("NO" in the step S105), the CPU 701 proceeds with the process to step S107. That is, the CPU 701 determines whether a predetermined period elapsed after sending the participation request to the downstream apparatus (the step S107). When the predetermined period elapsed ("YES" in the step S107), the CPU 701 proceeds with the process to step S108.

Namely, the CPU 701 sets the downstream-most setting stored in the RAM 703 to "downstream-most" and sets the downstream connection setting to "connected" (the step S108). In this case, although the cable is connected, a response from the downstream apparatus does not received even if the predetermined period elapsed after sending the participation request. In such a case, the CPU 701 recognizes that the downstream apparatus is out of order and determines that the own apparatus is the downstream-most apparatus in the system. Then, the CPU 701 turns ON the input port 741 to set the own apparatus as the downstream-most apparatus in the image forming system in order not to transfer a sheet to a downstream apparatus, and then proceeds with the process to the step S110. In the meantime, as a result of the determination in the step S107, when the predetermined period does not elapse ("NO" in the step S107), the CPU 701 returns the process to the step S105.

Moreover, as a result of the determination in the step S103, when the input port 741 is ON and a downstream apparatus is not connected to the puncher 7 ("NO" in the step S103), the CPU 701 proceeds with the process to step S109. Namely, the CPU 701 sets the downstream-most setting stored in the RAM 703 to "downstream-most" and sets the downstream connection setting to "unconnected" (the step S109), and then proceeds with the process to the step S110.

According to the process in FIG. 5, when receiving the participation request to the system from the image forming apparatus 1 as the upstream apparatus, the puncher 7 as the downstream apparatus responds to the request (the step S102). Moreover, the puncher 7 as the downstream apparatus sends the participation request to the finisher 5 as the post-processing apparatus in the case where the finisher 5 is connected to the downstream side of the puncher 7 (the step S104). Then, when the finisher 5 responds, the puncher 7 sets the downstream-most setting to "non-downstream-most" and sets the downstream connection setting to "connected" (the step S106). Moreover, the puncher 7 notifies the image forming apparatus 1 as the upstream apparatus of the participation to the system regardless of a response from the finisher 5 (the step S112). This enables to fix the participation or nonparticipation of a post-processing apparatus like the puncher 7 to the system. As a result of this, the image forming system that consists of the image forming apparatus 1 and the puncher 7 that is the downstream apparatus is constructed, for example.

In the embodiment, the additional information that the CPU 701 of the puncher 7 notifies the image forming apparatus 1 with the participation to the system is as follows, for example.

When the finisher 5 is connected to the downstream side of the puncher 7, when the puncher 7 and the finisher 5 are connected through the cable, and when the finisher 5 is not broken, the process flow passes the step S106. At this time, the CPU 701 of the puncher 7 notifies the image forming apparatus 1 of "non-downstream-most" as the downstream-most setting, "connected" as the downstream connection setting, and "absence" as the sheet-stacking-tray information.

Moreover, when the puncher 7 and the finisher 5 are connected through the cable, and when there is no response in the step S105 because of a failure of the finisher 5, the process flow passes the step S108. At this time, the CPU 701 of the puncher 7 notifies the image forming apparatus 1 of "downstream-most" as the downstream-most setting, "connected" as the downstream connection setting, and "absence" as the sheet-stacking-tray information.

Moreover, when the finisher 5 that was connected to the downstream side of the puncher 7 is out of order and is separated from the image forming system, the process flow passes the step S109. At this time, the CPU 701 notifies the image forming apparatus 1 of "downstream-most" as the downstream-most setting, "unconnected" as the downstream connection setting, and "absence" as the sheet-stacking-tray information.

Next, a forced-discharge-mode setting process executed by the image forming system 1000 in FIG. 1 will be described. The CPU 101 of the image forming apparatus 1 in the image forming system 1000 executes the forced-discharge-mode setting process when the power is supplied according to a forced-discharge-mode setting program stored in the ROM 102.

FIG. 6 is a flowchart showing procedures of the forced-discharge-mode setting process executed by the image forming system 1000.

As shown in FIG. 6, when the forced-discharge-mode setting process is started, the CPU 101 first determines whether a post-processing apparatus is connected to the downstream side of the image forming apparatus 1 (step S201). As a result of the determination in the step S201, when a post-processing apparatus is connected and the input port 141 of the image forming apparatus 1 is OFF ("YES" in the step S201), the CPU 101 proceeds with the process to step S202.

That is, the CPU 101 sends a command that requests the puncher 7 as a downstream apparatus to participate to the system by turning ON the output port 121 (the step S202). After requesting the puncher 7 to participate to the system (the step S202), the CPU 101 determines whether the input port 122 is turned ON according to a response from the puncher 7 (step S203). As a result of the determination in the step S203, when there is a response from the puncher 7 ("YES" in the step S203), the CPU 101 proceeds with the process to step S204.

That is, the CPU 101 waits until the notice is received while determining whether a notice showing the participation to the system is received from the puncher 7 as the post-processing apparatus through the communication interface 104 (the step S204). As a result of the determination in the step S204, when the notice showing the participation to the system is received from the puncher 7 ("YES" in the step S204), the CPU 101 proceeds with the process to step S205. That is, the CPU 101 stores the setting contents of the downstream-most setting and downstream connection setting, and the sheet-stacking-tray information that are notified from the puncher 7 into the RAM 103 (the step S205). The RAM 103 is a memory that stores the setting contents of the downstream-most setting and downstream connection setting, and the sheet-stacking-tray information about each post-processing apparatus.

After storing the setting contents of the downstream-most setting etc. into the RAM 103 (the step S205), the CPU 101 determines whether the downstream-most setting about the puncher 7 that notified of the participation to the system is "downstream-most" on the basis of the received information (step S206). As a result of the determination in the step S206, when the downstream-most setting about the puncher 7 that notified of the participation is "downstream-most" ("YES" in the step S206), the CPU 101 finishes the network construction and proceeds with the process to step S207. That is, the CPU 101 determines whether the sheet-stacking-tray information is "absence" about the puncher 7 of which the downstream-most setting stored in the RAM 103 is set to "downstream-most" (step S207).

As a result of the determination in the step S207, when the sheet-stacking-tray information is "absence" ("YES" in the step S207), the CPU 101 proceeds with the process to step S208. That is, the CPU 101 checks whether the downstream connection setting of the puncher 7 stored in the RAM 103 is "unconnected" (step S208).

As a result of the determination in the step S208, when the downstream connection setting is "unconnected" ("YES" in the step S208), the CPU 101 determines as follows. That is, the CPU 101 determines that the post-processing apparatus (finisher 5) equipped with the sheet stacking tray that had been connected to the downstream side of the puncher 7 broke down and was separated from the system on control. Since the sheet stacking tray is attached to the downstream-most apparatus in general, it is hard to consider that the puncher 7 that is not equipped with the sheet stacking tray was the downstream-most apparatus from the beginning in view of the system configuration in this case.

After determining that the post-processing apparatus equipped with the sheet stacking tray broke down and was separated from the image forming system ("YES" in the step S208), the CPU 101 determines whether the setting of the forced discharge mode stored in the SRAM 108 is ON (step S209).

How to set the forced discharge mode to "ON" will be described. Before starting of a print job, a user sets the forced discharge mode using the operation display unit 4.

Figure 7A:
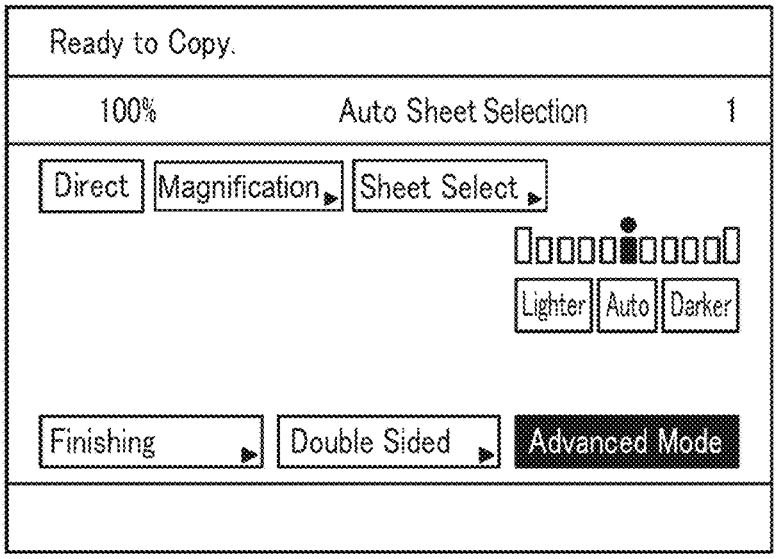
FIG. 7A, FIG. 7B, and FIG. 7C are views showing operation screens displayed on the display section of the operation display unit when a forced discharge mode is set up.
Figure 7B:
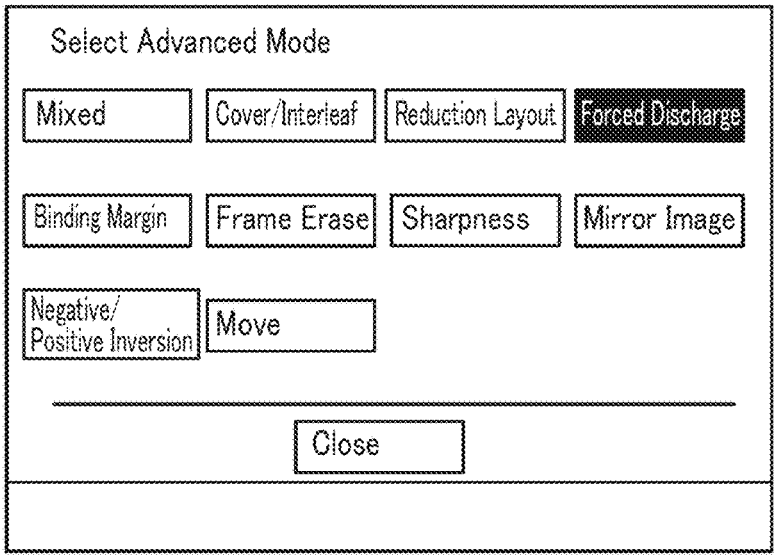
Figure 7C:
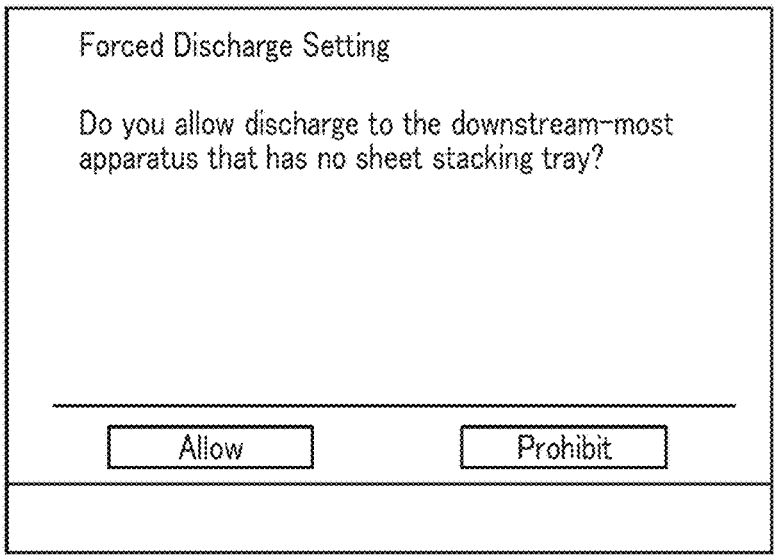

FIG. 7A, FIG. 7B, and FIG. 7C are views showing operation screens of the operation display unit 4 when the forced discharge mode is set up. In an initial screen in FIG. 7A, when the user presses an "application mode" key that is a softkey, the operation-display-device controller 107 displays an application mode setting screen in FIG. 7B on the operation display unit 4.

In the application mode setting screen in FIG. 7B, when the user presses a "forced discharge" key that is a softkey, the operation-display-device controller 107 changes the display to a forced-discharge-mode setting screen in FIG. 7C. When the user presses a "close" key in the application mode setting screen in FIG. 7B, the operation-display-device controller 107 returns the display to the initial screen in FIG. 7A.

When the user presses an "allow" key in the forced-discharge-mode setting screen in FIG. 7C, the forced discharge mode setting stored in the SRAM 108 of the image forming apparatus 1 is set to "ON", and the forced discharge mode is set up. After the forced discharge mode is set up, the operation-display-device controller 107 changes the operation screen to the initial screen in FIG. 7A. In the meantime, when the user presses a "prohibit" key in the forced-discharge-mode setting screen in FIG. 7C, the forced discharge mode setting stored in the SRAM 108 of the image forming apparatus 1 is set to "OFF", and the forced discharge mode is not set up. Then, the operation-display-device controller 107 changes the operation screen to the initial screen in FIG. 7A. When setting up the forced discharge mode in the operation screen in FIG. 7C, the user needs to open a discharging port of the puncher 7 by separating physically the downstream-most apparatus, which is separated from the system, from the puncher 7 at the upstream side of the downstream-most apparatus concerned.

Referring back to FIG. 6, as a result of the determination in the step S209, the forced discharge mode setting is "ON" ("YES" in the step S209), the CPU 101 sets the sheet-stacking-tray information about the puncher 7 stored in the RAM 103 to "presence" (step S210). Next, the CPU 101 finishes this process. The following process becomes available by setting the sheet-stacking-tray information about the puncher 7 that is the downstream-most apparatus to "presence". That is, since the puncher 7 is apparently assumed to have a sheet stacking tray in the system that cannot execute a post process and sheet discharge because the puncher 7 as the downstream-most apparatus does not have a sheet stacking tray actually, the punch process (post process) and the sheet discharge to the puncher 7 become available.

Hereinafter, a finishing setting method in the case where the finisher 5 that was connected to the downstream side of the puncher 7 as shown in FIG. 1 is separated and the sheet-stacking-tray information about the puncher 7 stored in the RAM 103 is set to "presence" by setting the forced discharge mode will be described.

Figure 8A:
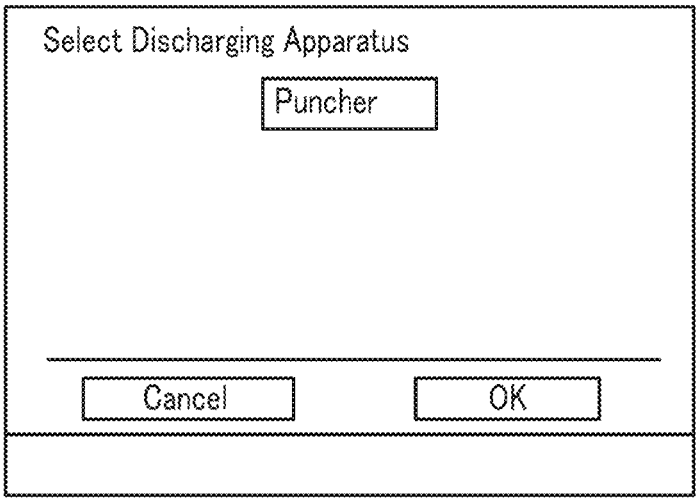
FIG. 8A and FIG. 8B are views showing selection screens displayed on the display section of the operation display unit when a "Finishing" key is selected.
Figure 8B:
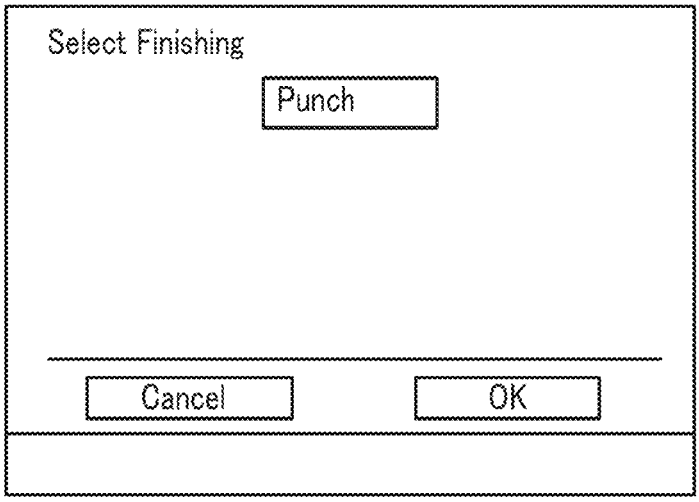

FIG. 8A and FIG. 8B are views showing display screens displayed when the "finishing" key is selected in the operation screen of the operation display unit 4. When the sheet-stacking-tray information about the puncher 7 is apparently set to "presence", the "puncher" becomes selectable as the sheet discharging apparatus as shown in FIG. 8A. It should be noted that the "finisher" separated from the image forming system 1000 is not displayed in FIG. 8A and is not selectable as the sheet discharging apparatus.

When the user selects the "puncher" and presses the "OK" key that is a softkey in the display screen in FIG. 8A, a finishing selection screen as shown in FIG. 8B is displayed on the display section 420. In FIG. 8B, the "punch" process that is the function of the puncher 7 connected to the image forming system is selectable. The "shift" process that is the function of the finisher 5 separated from the image forming system and is displayed in the screen in FIG. 4C is not displayed and cannot be selectable.

Referring back to FIG. 6, as a result of the determination in the step S209, the forced discharge mode setting is "OFF", the CPU 101 finishes this process. Since the forced discharge mode is not set up, a sheet cannot be discharged to the puncher 7 and the print job becomes inexecutable.

Moreover, when the sheet-stacking-tray information is "presence" ("NO" in the step S207) as a result of the determination in the step S207 and when the downstream connection setting is "connected" ("NO" in the step S208) as a result of the determination in the step S208, the CPU 101 finishes this process. In this case, a sheet is not forcibly discharged from the puncher 7 that is a downstream apparatus of the image forming apparatus 1.

Moreover, as a result of the determination in the step S206, when the post-processing apparatus (puncher 7) that notified of the participation is not "downstream-most" ("NO" in the step S206), the CPU 101 returns the process to the step S204 and continues the network construction.

Moreover, as a result of the determination in the step S203, when the input port 122 is OFF, that is, when there is no response from the downstream apparatus ("NO" in the step S203), the CPU 101 proceeds with the process to step S211. In the step S211, the CPU 101 determines whether the predetermined period elapsed after requesting participation from the downstream apparatus. As a result of the determination in the step S211, when the predetermined period elapsed without receiving a response ("YES" in the step S211), the CPU 101 finishes this process on the assumption that no downstream apparatus participates. That is, the CPU 101 determines that the downstream apparatus is out of order because there is no response until the predetermined period elapses after requesting participation from the downstream apparatus. Since a sheet cannot be conveyed to the downstream apparatus in such a case, the CPU 101 finishes this process on the assumption that a post-processing apparatus is not connected. In the meantime, as a result of the determination in the step S211, when the predetermined period did not elapse ("NO" in the step S211), the CPU 101 returns the process to the step S203.

Moreover, as a result of the determination in the step S201, when the input port 141 is ON, that is, when no downstream apparatus is connected ("NO" in the step S201), the CPU 101 finishes this process because the system cannot be constructed.

The process in FIG. 6 provides the mode that allows the forced discharge to the post-processing apparatus (puncher 7) that is not provided with a sheet stacking tray and that became the downstream-most apparatus resulting from separating the broken post-processing apparatus from the image forming system 1000 (the step S209). This enables to perform a print job even when a post-processing apparatus equipped with a sheet stacking tray is separated from the system due to a failure. Moreover, as a result of separating a broken post-processing apparatus from the image forming system, a post-processing function of a post-processing apparatus that became a downstream-most apparatus that is not broken, for example, the punching function of the puncher 7, becomes available.

That is, according to the embodiment, even if a post-processing apparatus equipped with a sheet stacking tray breaks down and is separated from a system, influence on execution of a print job or a post-processing function is reduced in comparison with the prior art.

In the embodiment, a sheet discharged from a post-processing apparatus that does not have a sheet stacking tray used as the downstream-most apparatus is received by a user or is received with a sheet stacking tray that is newly installed by a user.

The setting contents of the downstream-most setting and downstream connection setting of the post-processing apparatus and the sheet-stacking-tray information that are stored in the RAM 103 may be reported to a user by displaying them on the display screen of the operation display unit 4 with a specification result of the downstream-most apparatus in the embodiment.

A post-processing apparatus specified as an available downstream-most apparatus differs according to the settings or a failure of another post-processing apparatus in the embodiment.

Hereinafter, behavior of the image forming system in a case where the broken finisher 5 is separated from the image forming system shown in FIG. 1 and where the sheet-stacking-tray information about the puncher 7 is kept as "absence" without setting the forced discharge mode will be described.

Figure 9A:
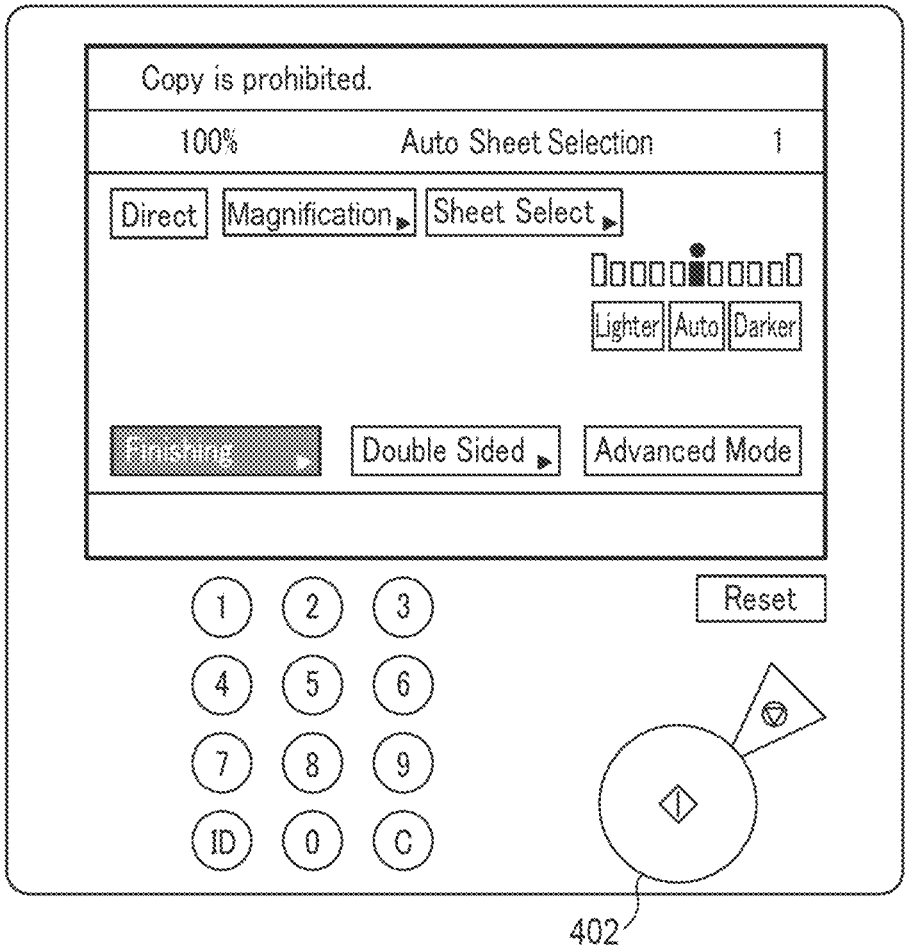
FIG. 9A and FIG. 9B are views showing pop-up screens displayed on the operation display unit and the display section when the forced discharge mode is not set up.

Since the finisher 5 that has the sheet stacking tray is separated and the puncher 7 does not have a sheet stacking tray, the "finishing" key is grayed out as shown in FIG. 9A and is not selectable even if a user is going to execute a print job through the operation display unit 4. Accordingly, the user cannot set up the discharging apparatus and the post-process mode. That is, since the puncher 7 does not have a sheet stacking tray, the image forming apparatus 1 cannot discharge a sheet to the puncher 7 concerned. As a result of this, the finishing process using the puncher 7 and the discharge of a sheet from the puncher 7 become impossible. Moreover, even if the user presses the start key 402 in this state, the image forming operation is not started.

In the meantime, when a user is going to execute a print job through a printer driver from an external computer and when the printer driver automatically updates the configuration of the image forming system, the image forming system behaves as follows. That is, since the puncher 7 does not have a sheet stacking tray on which a sheet after the post-process is stacked, a discharging apparatus cannot be designated and a post-process mode cannot be set up from the printer driver. As a result, a print job using the image forming system concerned cannot be executed.

Figure 9B:
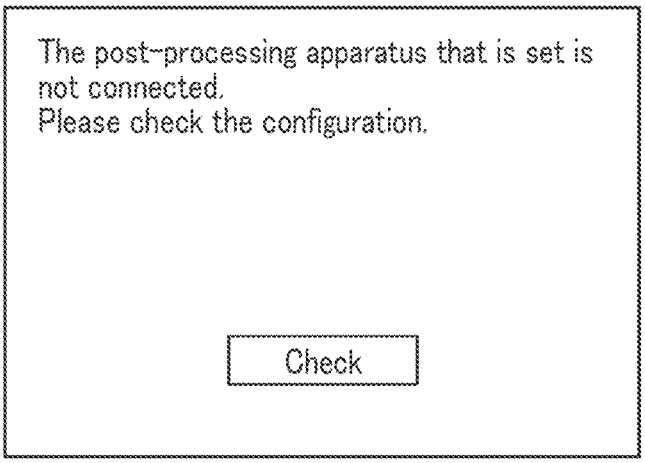

On the other hand, when the configuration of the image forming system is not updated automatically and when a user is going to execute a print job while keeping the broken finisher 5 as the discharging apparatus, the image forming system behaves as follows. That is, since the finisher 5 that has the sheet stacking tray is out of order, a pop-up screen as shown in FIG. 9B is displayed on the operation display unit 4, and the image forming operation cannot be started.

In this way, when the broken finisher 5 is separated, the image forming system that cannot set up the forced discharge mode cannot perform a print job and cannot execute the punching process of the puncher 7 that is not out of order. As compared with this, even if the post-processing apparatus equipped with the sheet stacking tray breaks down the system that enables to set up the forced discharge mode is able to perform a print job and is able to use the post-processing function of the puncher 7 that is not out of order,

Other Embodiments

Embodiment(s) of the disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-085642, filed Apr. 26, 2018, which is hereby incorporated by reference herein in its entirety.

What is claimed is:

1. An image forming system comprising:

an image forming apparatus that forms an image on a sheet;

one or more post-processing apparatuses that are connected at a downstream side of the image forming apparatus in a sheet conveyance direction and that apply predetermined post-processes to the sheet that is discharged from the image forming apparatus;

a specifying unit configured to specify an available downstream-most apparatus from among the one or more post-processing apparatuses;

a setting unit configured to be able to set a forced discharge mode in which a sheet is discharged to the post-processing apparatus specified as the downstream-most apparatus by the specifying unit in a case where the post-processing apparatus specified is not provided with a sheet stacking unit for stacking a sheet after the post-process; and a controller configured to control apparatuses at an upstream side of the post-processing apparatus specified as the downstream-most apparatus so as to discharge a sheet to the post-processing apparatus specified and to control the post-processing apparatus specified so as to discharge the sheet outside the apparatus after applying a predetermined post-process in a case where the setting unit sets the forced discharge mode.

2. The image forming system according to claim 1, wherein the controller controls so as not to discharge a sheet to the post-processing apparatus that is not provided with the sheet stacking unit for stacking a sheet to which the post-process is applied in a case where the forced discharge mode is not set up.

3. The image forming system according to claim 2, wherein the controller prohibits starting a print job in a case where the one or more post-processing apparatuses are not provided with the sheet stacking unit.

4. The image forming system according to claim 1, wherein the specifying unit is provided in each of the one or more post-processing apparatuses, and wherein the downstream-most apparatus is specified by determining whether each of the apparatuses is the downstream-most apparatus.

5. The image forming system according to claim 4, wherein the specifying unit provided in a particular post-processing apparatus of the one or more post-processing apparatuses comprises:

a first determination unit that determines whether a downstream apparatus is connected to the particular post-processing apparatus by specifying whether the particular post-processing apparatus is a termination apparatus in the image forming system; and a second determination unit that determines whether a downstream apparatus is connected according to a control signal, and wherein the specifying unit specifies the particular post-processing apparatus as the downstream-most apparatus in a case where one of the first determination unit and the second determination unit determines that a downstream apparatus is not connected.

6. The image forming system according to claim 1, wherein a post-processing apparatus specified as the downstream-most apparatus varies according to a setting or a failure of another post-processing apparatus.

7. The image forming system according to claim 5, wherein a post-processing apparatus is specified as the downstream-most apparatus as a result of separating another post-processing apparatus, which is equipped with the sheet stacking unit and was connected to the downstream side of the post-processing apparatus specified, from the image forming system on control.

8. The image forming system according to claim 1, further comprising a display unit configured to notify a user of information, wherein the display unit notifies the user by displaying a specification result of the specifying unit on a display screen.

9. The image forming system according to claim 8, wherein the display unit notifies the user of information about a downstream-most setting, information about a downstream connection setting, and information about a sheet stacking tray in the post-processing apparatus specified as the downstream-most apparatus in addition to the specification result of the specifying unit.

10. A control method for an image forming system comprising an image forming apparatus that forms an image on a sheet and one or more post-processing apparatuses that are sequentially connected at a downstream side of the image forming apparatus in a sheet conveyance direction and that apply predetermined post-processes to the sheet that is discharged from the image forming apparatus, the control method comprising:

a specifying step of specifying an available downstream-most apparatus from among the one or more post-processing apparatuses;

a setting step of being able to set a forced discharge mode in which a sheet is discharged to the post-processing apparatus specified as the downstream-most apparatus in the specifying step in a case where the post-processing apparatus specified is not provided with a sheet stacking unit for stacking a sheet to which the post-process is applied; and a control step of controlling apparatuses at an upstream side of the post-processing apparatus specified as the downstream-most apparatus so as to discharge a sheet to the post-processing apparatus specified and of controlling the post-processing apparatus specified so as to discharge the sheet outside the apparatus after applying a predetermined post-process in a case where the setting unit sets the forced discharge mode.

11. A non-transitory computer-readable storage medium storing a control program causing a computer to execute a control method for an image forming system comprising an image forming apparatus that forms an image on a sheet and one or more post-processing apparatuses that are sequentially connected at a downstream side of the image forming apparatus in a sheet conveyance direction and that apply predetermined post-processes to the sheet that is discharged from the image forming apparatus, the control method comprising:

a specifying step of specifying an available downstream-most apparatus from among the one or more post-processing apparatuses;

a setting step of being able to set a forced discharge mode in which a sheet is discharged to the post-processing apparatus specified as the downstream-most apparatus in the specifying step in a case where the post-processing apparatus specified is not provided with a sheet stacking unit for stacking a sheet to which the post-process is applied; and a control step of controlling apparatuses at an upstream side of the post-processing apparatus specified as the downstream-most apparatus so as to discharge a sheet to the post-processing apparatus specified and of controlling the post-processing apparatus specified so as to discharge the sheet outside the apparatus after applying a predetermined post-process in a case where the setting unit sets the forced discharge mode.

12. An image forming apparatus comprising:

an image forming unit configured to form an image on a sheet;

a determination unit configured to determine whether one or more post-processing apparatuses that apply predetermined post-processes to a sheet are connected;

an obtaining unit configured to obtain information about whether a downstream-most post-processing apparatus among the one or more post-processing apparatuses is provided with a sheet stacking unit for stacking a sheet to which the post-process is applied in a case where the determination unit determines that the one or more post-processing apparatuses are connected;

a setting unit configured to set whether discharge of a sheet to the downstream-most post-processing apparatus is allowed in a case where the downstream-most post-processing apparatus is not provided with the sheet stacking unit; and a controller configured to control so as to discharge a sheet to the downstream-most post-processing apparatus that is not provided with the sheet stacking unit in a case where the setting unit sets to allow discharge of a sheet and to control so as not to discharge a sheet to the downstream-most post-processing apparatus that is not provided with the sheet stacking unit in a case where the setting unit does not set to allow discharge of a sheet.

* * * * *